US008277115B2

(12) United States Patent
Pensler et al.

(10) Patent No.: US 8,277,115 B2
(45) Date of Patent: Oct. 2, 2012

(54) GUIDING DEVICE FOR SUBMERSIBLE MOTOR AGITATORS

(75) Inventors: Thomas Pensler, Langenbogen (DE); Juergen Geinitz, Halle/Saale (DE)

(73) Assignee: KSB Aktiengesellschaft, Frankenthal (DE)

( * ) Notice: Subject to any disclaimer, the term of this patent is extended or adjusted under 35 U.S.C. 154(b) by 212 days.

(21) Appl. No.: 12/820,785

(22) Filed: Jun. 22, 2010

(65) Prior Publication Data

US 2010/0296364 A1 Nov. 25, 2010

Related U.S. Application Data

(63) Continuation of application No. PCT/EP2008/010564, filed on Dec. 12, 2008.

(30) Foreign Application Priority Data

Dec. 22, 2007 (DE) ..... 10 2007 062 563

(51) Int. Cl.
*B01F 7/06* (2006.01)

(52) U.S. Cl. ..... 366/286; 366/285; 261/93

(58) Field of Classification Search ..... 366/285, 366/286; 261/93
See application file for complete search history.

(56) References Cited

U.S. PATENT DOCUMENTS

| | | | | |
|---|---|---|---|---|
| 1,111,715 | A * | 9/1914 | Hood | 366/285 |
| 1,803,446 | A * | 5/1931 | Warrick | 248/560 |
| 4,431,597 | A | 2/1984 | Cramer et al. | |
| 4,581,182 | A | 4/1986 | Cramer et al. | |
| 4,671,872 | A | 6/1987 | Cramer et al. | |
| 6,036,246 | A | 3/2000 | Liedtke | |
| 6,276,825 | B2 * | 8/2001 | Running et al. | 366/270 |
| 6,802,643 | B1 * | 10/2004 | Cato et al. | 366/262 |
| 2002/0162936 | A1 | 11/2002 | Mellardo et al. | |

FOREIGN PATENT DOCUMENTS

| | | |
|---|---|---|
| DE | 40 15 478 C1 | 9/1991 |
| DE | 195 43 525 C1 | 2/1997 |
| DE | 198 45 545 A1 | 8/1999 |
| EP | 0 107 406 A2 | 5/1984 |
| FR | 2 541 557 | 8/1984 |

OTHER PUBLICATIONS

International Search Report (Form PCT/ISA/210) dated Jun. 8, 2009 with partial English translation, including Forms PCT/ISA/237 (Ten (10) pages).

German Search Report dated Oct. 22, 2008 with partial English translation (Nine (9) pages).

* cited by examiner

*Primary Examiner* — David Sorkin

(74) *Attorney, Agent, or Firm* — Crowell & Moring LLP

(57) ABSTRACT

A guiding device for submersible motor agitators having a guiding tube and a sliding carriage for carrying a submersible motor agitator. The guiding tube is held in a pivotable lower mount and in an upper mount composed of a bracket and an adjusting lug, and the angular position of the guiding tube can be adjusted via the adjusting lug. The sliding carriage, the adjustment lug and any optional connecting lug are dimensioned in such a way that the sliding carriage carrying the submersible motor agitator can be removed from the guiding tube without disassembling the guiding device.

16 Claims, 9 Drawing Sheets

GUIDING DEVICE FOR SUBMERSIBLE MOTOR AGITATORS

CROSS REFERENCE TO RELATED APPLICATIONS

This application is a continuation of international patent application no. PCT/EP2008/010564, filed Dec. 12, 2008, designating the United States of America and published in German on Jul. 2, 2009 as WO 2009/080224, the entire disclosure of which is incorporated herein by reference. Priority is claimed based on Federal Republic of Germany patent application no. DE 10 2007 062 563.6, filed Dec. 22, 2007.

BACKGROUND OF THE INVENTION

The invention relates to a guiding device for agitators, in particular submersible motor agitators. Submersible motor agitators are normally mounted in large pools, for example sewage treatment pools, with guiding devices being arranged at the pool edge. Guiding devices such as this in this case have to carry out the following tasks:

First, the submersible motor agitator must be guided from the pool edge into the pool. Furthermore, a stop must be provided on the guiding device, which defines the position of the unit in the pool and ensures the necessary distance between the agitating member and the pool bottom. Furthermore, the guiding device is intended to provide the capability to vary the outlet flow direction, which is induced by the submersible motor agitator, with reference to the pool wall. Furthermore, the guiding device must withstand all the forces which occur during operation of the submersible motor agitator and must introduce the forces and moments into the pool wall or the pool top and the pool bottom. In this case, it is necessary to compensate for the weight forces of the submersible motor agitator itself, the torque about the submersible motor agitator axis, the axial thrust through the agitating member, any lateral forces caused by the flow in the pool and by any aeration devices, as well as forces caused by inhomogeneity or density differences of the liquid medium.

Furthermore, the guiding device must be designed such that any inclinations of the pool bottom can be taken into account, with wall mounting being possible.

In known guiding devices, a submersible motor agitator is guided from the pool edge into the pool via quadrilateral tubes with a square cross section. A portion of the guiding devices has a rigidly attached guide tube. In this case, it is not possible to vary the outlet flow direction of the flow induced by the submersible motor agitator.

In general, it is desirable in the case of submersible motor agitators for the size of the housing units for the submersible motor agitator itself and the components of the guiding device to be kept as small as possible, in order to keep transport costs and transport volumes as low and small as possible. In this case, it may be advantageous for the guiding device to make use of components which do not necessarily need to be delivered at the same time but can easily be procured additionally by the customer in the delivery location.

In addition, guiding devices are already known which include the capability to adjust the outlet flow direction of the flow induced by the submersible motor agitator. Two fundamental designs are in principle known in this case. On the one hand, there is a design in which the guide tube axis also forms the rotation axis at the same time. In another design, the rotation axis is located outside the guide tube.

An increased manufacturing effort is required for guiding devices which have a rotation axis outside the guide tube axis.

In this case, a shorter quadrilateral tube is welded onto the lower face of the guide tube, that is to say in the area of the pool bottom, and can be mounted on a guide pin on the pool bottom. In some alternative embodiments, an additional welded part is pushed into the lower face of the guide tube and then forms the rotation point outside the guide tube axis. This results in more stringent requirements for the connection of the two parts, in order to allow the forces which are exerted on the system to be safely absorbed. Other guiding devices are known in which a holder for a spherical element is welded on the lower face of the guide tube and is mounted in a bush on the pool bottom, and thus forms a rotation point outside the guide tube axis.

On the other hand, in solutions in which the rotation axis lies within the guide tube, the attachment and removal of the submersible motor agitator during lowering into the pool and/or removal from the pool are particularly disadvantageous. In known embodiments, the submersible motor agitator can only be lifted out when the submersible motor agitator axis is at right angles to the pool wall. Furthermore, the adjusting lug by means of which the outlet flow direction is adjusted must be completely removed in order to allow the submersible motor agitator to be detached from the guide tube.

U.S. Pat. No. 4,581,182 discloses a guiding device which has a lower support for the guide tube so as to allow matching to the inclination of the pool bottom. This mount has no capability to rotate about the guide tube axis, as a result of which the outlet flow direction of the agitator flow induced by the agitator cannot be adjusted. Furthermore, in order to remove the submersible motor agitator, the guides for the sliding carriage on the side of the guide tube facing the wall must be removed.

In contrast, in U.S. Pat. No. 4,671,872, it is possible to vary the outlet flow direction of the submersible motor agitator using the guiding device. An upper attachment of the guide tube is provided with four clamping jaws, in a circular clamp, for this purpose. This arrangement is also subject to the disadvantage that it is complex and difficult to remove the guides for the sliding carriage on the side of the guide tube facing the wall.

A guiding device according to U.S. Pat. No. 4,431,597 is constructed in a similar manner. In this case, the capability of the guide tube to rotate is arranged considerably above the pool upper edge. However, the disadvantage in this case is that the entire sliding carriage must be removed when the submersible motor agitator is to be detached.

SUMMARY OF THE INVENTION

It is an object of the invention to provide a submersible motor agitator which can be installed or fitted and can be removed without complex fitting work, even in the case of a guiding device in which the rotation axis coincides with the axis of the guide tube.

This and other objects have been achieved in accordance with the present invention by the submersible motor agitator guiding device as described and claimed hereinafter.

A guiding device for submersible motor agitators is accordingly specified, which comprises at least one guide tube which is held at one end in a lower mount or attachment such that it can rotate about its axis and is connected at the other end, at its opposite end area, via an adjusting lug to an upper mount or attachment, where the upper attachment comprises a bracket which can be mounted in a fixed position and by means of which the adjusting lug can be attached via screws in predetermined angular positions.

Furthermore, a sliding carriage is provided for holding the submersible motor agitator. The carriage surrounds the guide tube on three sides and has clamps or holders on its side which does not surround the guide tube, which clamps or holders clasp the lateral edges of the guide tube and leave an intermediate space between them.

According to the invention, the area of the adjusting lug between the guide tube and the bracket is narrower than the intermediate space between the clamps or holders of the sliding carriage. The sliding carriage can therefore be pulled off the guide tube without having to undertake complex measures to remove the adjusting lug. This means that the guiding device retains its full stability even during installation and/or removal of the carriage carrying the submersible motor agitator. Because it is not necessary to remove the adjusting lug, it also is not necessary to ensure in a different manner that all the forces acting on the guide tube are actually reliably absorbed.

Preferred refinements of the invention will become apparent from the following description.

In one preferred embodiment, the clamps or holders of the sliding carriage are be formed by guide elements.

A molding, which can be inserted into the guide tube and whose shape is matched thereto, can be connected to the lower face of the adjusting lug. This allows the guide tube to be connected to the adjusting lug in a very simple manner. An extension which, for example, is likewise in the form of a quadrilateral tube can be connected on the upper face of the adjusting lug. At least one opening for receiving an adjusting tool, for example a fitting lever, may be provided in this extension.

In the case of very long guiding devices, the guide tube can also be supported by a center support. This once again advantageously comprises a fixed-position bracket and a connecting lug, which is likewise narrower in the area between the guide tube and the bracket than the intermediate space between the clamps or holders of the sliding carriage. In such case, the sliding carriage can therefore be moved along the entire height of the guide tube without in the meantime having to remove the connecting lug.

In addition, in the area of the center support, the connecting lug has in each case on the lower face, and advantageously on the upper face as well, moldings having a cross-sectional shape which matches the guide tube and which can be inserted into the respective guide tube pieces.

These moldings as well as the molding of the adjusting lug may advantageously have a coating composed of a resilient or elastic material, which on the one hand simplifies assembly and on the other hand, if designed appropriately, ensures that the guide tube is firmly seated.

According to a further advantageous refinement of the invention, the brackets of the upper and/or center support have curved longitudinal slots, and at least one connecting element, such as a threaded screw, passes through these longitudinal slots and connects the respective adjusting lug or connecting lug to a holding plate. In this case, the connecting element is advantageously joined to a guide plate or to guide rollers, which are guided in the longitudinal slot.

The adjusting lug and the bracket can be connected to one another via a plurality of screws. This makes it possible to transfer the comparatively high forces that occur from the guide tube into the pool wall.

A series of screw holes may be provided in the guide plate, allowing the adjusting lug to be attached after pivoting through a predetermined pivoting angle.

BRIEF DESCRIPTION OF THE DRAWINGS

The invention will be described in further detail hereinafter with reference to illustrative preferred embodiments shown in the accompanying drawing figures in which.

DETAILED DESCRIPTION OF ILLUSTRATIVE EMBODIMENTS

Figure 1:
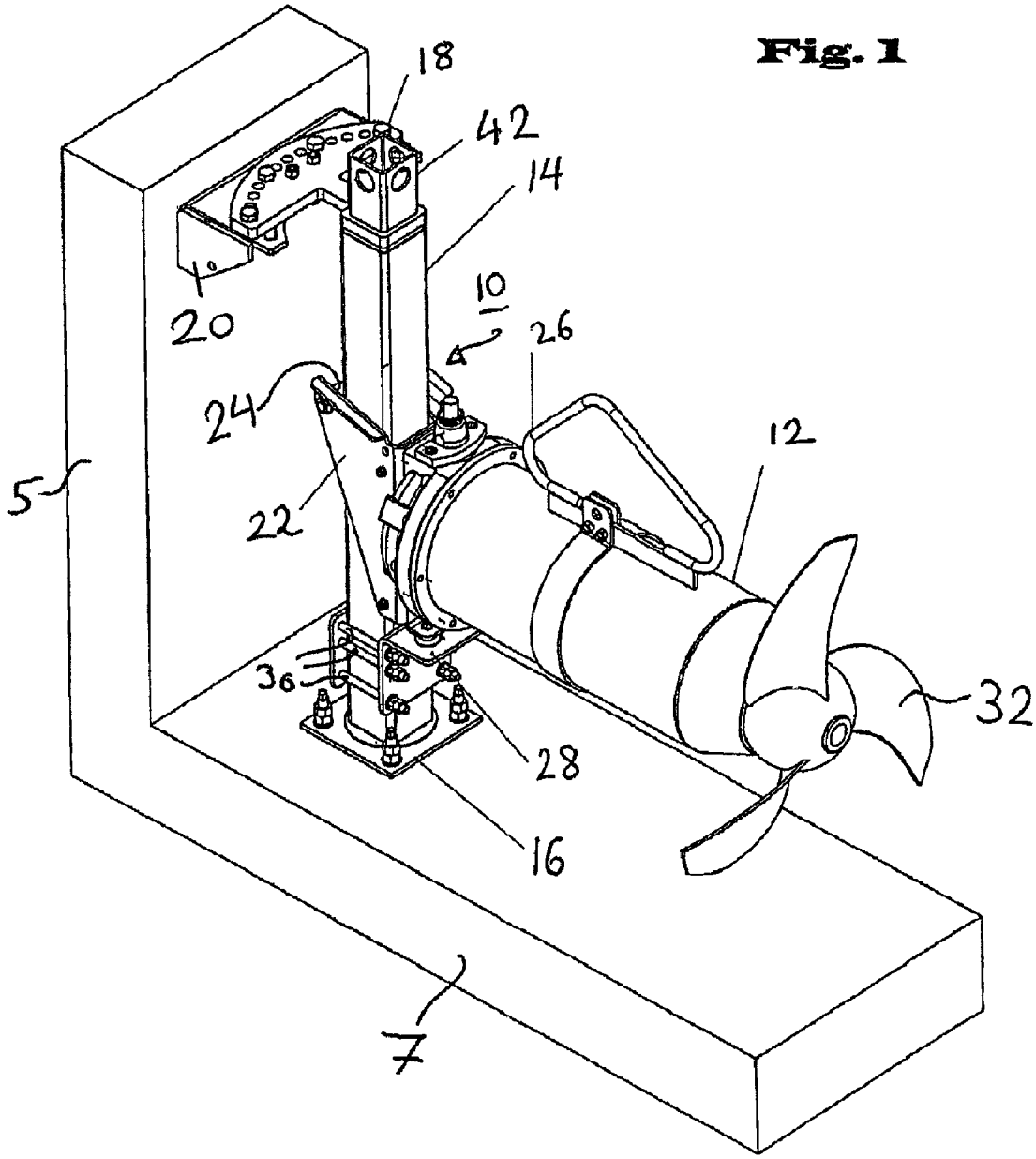
FIG. 1 is a perspective view of a first embodiment of the guiding device according to the invention, with a submersible motor agitator installed thereon.

FIG. 1 shows a first embodiment of a guiding device 10, which fixes the submersible motor agitator 12 in the area of a pool edge 5. The guiding device 10 essentially comprises a guide tube 14 which is made of a commercially available quadrilateral (e.g. square) tube. Since this is a commercially available quadrilateral tube, it can be procured locally at the point of use by the operator, thus making it possible overall to reduce the transport costs for delivery of the guiding device.

Figure 2:
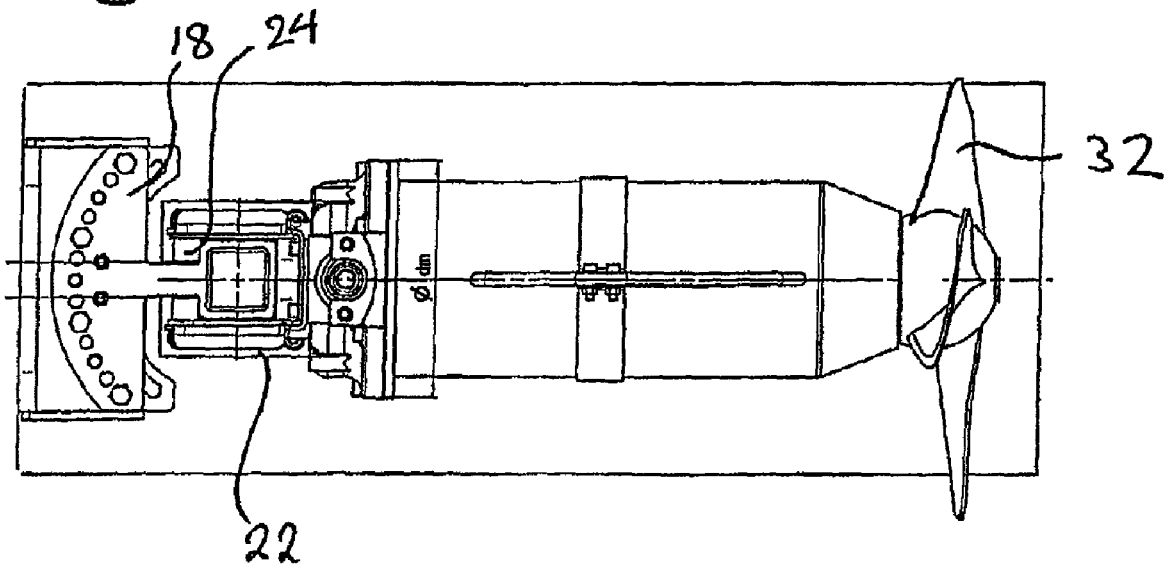
FIG. 2 is a plan view of the guiding device shown in FIG. 1.

The guide tube 14 for the guiding device 10 can rotate about its own axis. For this purpose, it is held in a lower mount 16 such that it can rotate. On its opposite end area, the guide tube is connected via an adjusting lug 18 to an upper mount. This upper mount comprises a bracket 20 which is attached to the pool wall 5 at a fixed position. The submersible motor agitator 12 is mounted on the guide tube via a sliding carriage 22. The sliding carriage 22 surrounds the guide tube 14 on three sides, as shown in FIGS. 1 and 2. On its side which does not surround the guide tube, the sliding carriage 2 has guide elements 24 as clamps or holders, enclosing the lateral edges tube 14. These may also take the form of rollers.

As can clearly be seen from FIG. 1, the submersible motor agitator 12 can be moved up and down along the guide tube by hooking a hoist, which is not illustrated in any more detail here, in the bracket 26, with the guide rollers rolling along the guide tube 14.

The submersible motor agitator can be fixed by supporting it on a supporting plate 28, which is firmly connected to the guide tube by clamping screws. This supporting plate 28 forms a lower stop for the submersible motor agitator. This reliably makes it possible to prevent the agitating member 32 on the submersible motor agitator from coming into contact with the pool bottom 7.

The upper attachment 18, 20 of the guiding device 10 will be explained in more detail with reference to FIGS. 5 and 6. The mounting bracket 20 illustrated here is attached to the pool wall 5 via connecting anchors, which are not illustrated in any more detail here. In this embodiment a curved longitudinal slot 34 is formed in the mounting bracket. The connection between the guide tube 14 and the mounting bracket 20 is made via the adjusting lug 18, which has only a comparatively narrow web-like area 36 between the guide tube 14 and the bracket 20. This web-like area is kept sufficiently narrow that it is narrower than the intermediate space between the guide rollers 24 of the sliding carriage 22 (see FIG. 2). The entire submersible motor agitator 12 can in this way be pulled off the guide tube 14 without having to disassemble and remove the upper attachment 18, 20 to do so.

A quadrilateral tube is welded onto the lower face of the adjusting lug 18 and can be inserted as a molding 38 into the guide tube 14. A coating 40 composed of a resilient or elastic material is provided on the molding 38, which is in the form of a quadrilateral tube, and ensures that the molding 38 is seated tightly in the guide tube 14. An extension 42, which is likewise in the form of a quadrilateral tube and has four recesses 44, is welded on the upper face of the adjusting lug 18. An adjusting tool can be inserted into these recesses, in a manner which is not illustrated in any more detail here, by means of which the guiding device and therefore the submersible motor agitator installed thereon can be pivoted.

Figure 5:
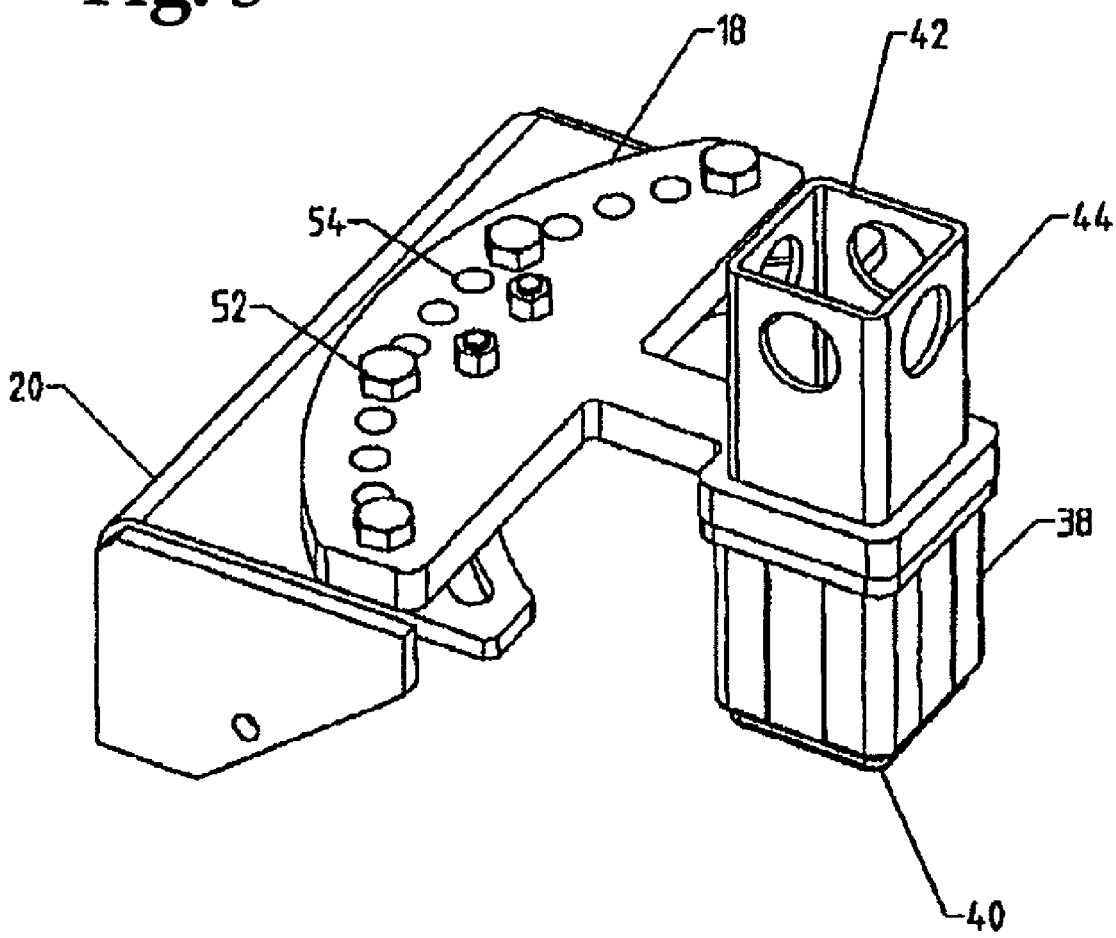
FIGS. 5 and 6 are perspective views from different viewing directions of a part of the guiding devices shown in FIG. 1 and FIG. 4, respectively.
Figure 6:
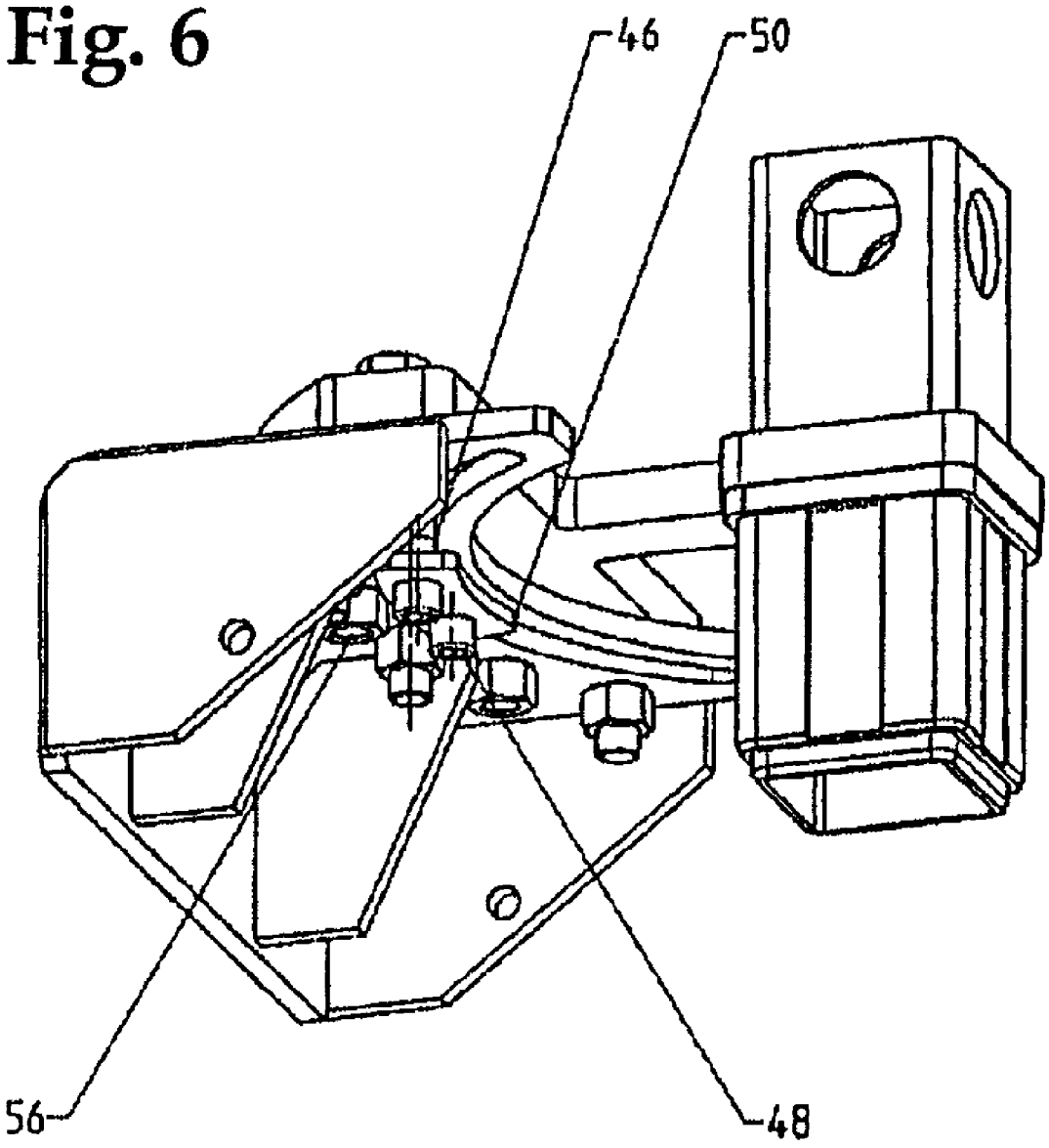

As is clear from FIGS. 5 and 6, the adjusting lug 18 is guided on the bracket 20 via rollers 46, which pass through the longitudinal slot 34 in the bracket 20, and by the plate 50, which is attached via two cylindrical screws 48, on the lower face of the bracket 20. The firm connection between the adjusting lug 18 and the bracket 20, and therefore the transmission of the forces exerted on the assembly from the guide tube 14 into the pool wall 5, are provided by four hexagonal screws 52. There are a series of drilled holes 54 in the adjusting lug 18, corresponding to these hexagonal screws 52. The screws 52 are screwed into corresponding nuts 56 (see FIG. 6), which are arranged on the lower face of the bracket.

The screw holes 54 are arranged in the adjusting lug so as to allow the guiding device to be pivoted in steps in both directions.

Figure 3:
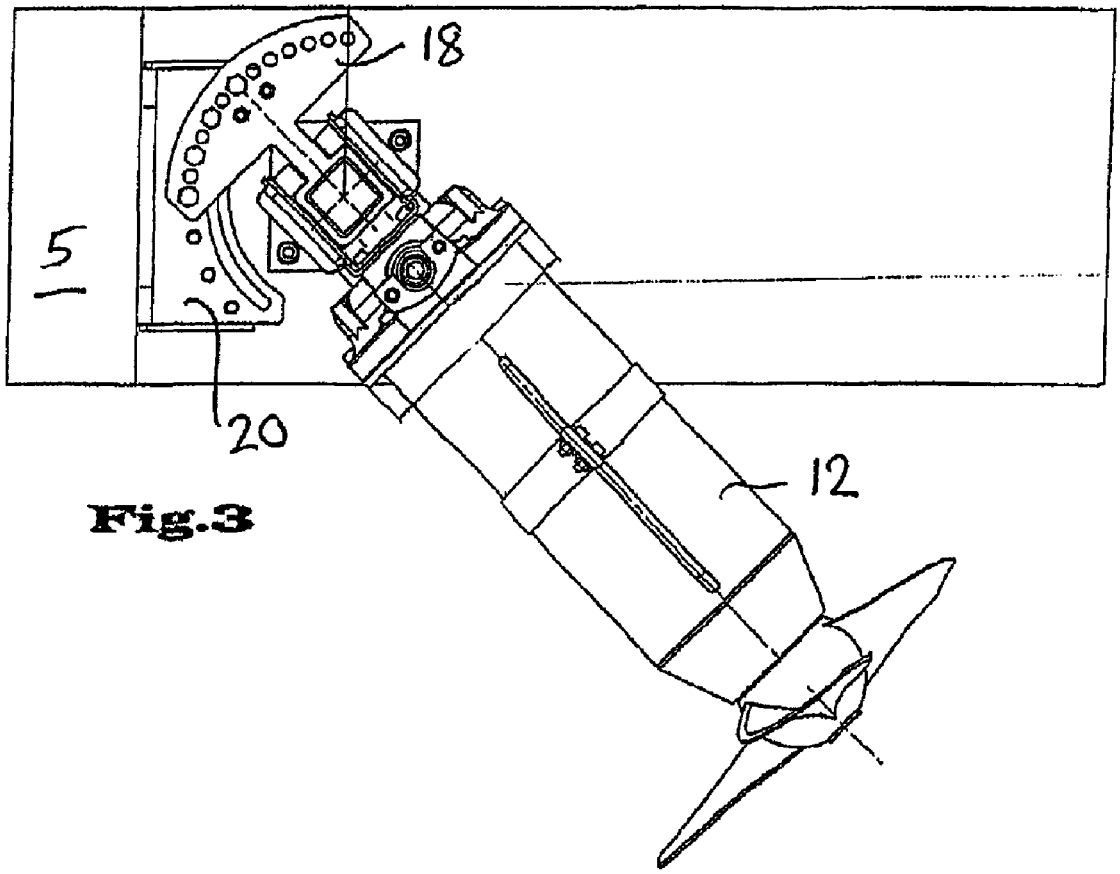
FIG. 3 is a plan view of the guiding device shown in FIG. 1, but with the submersible motor agitator having been pivoted through an angle of 45°.

By way of example, FIG. 3 illustrates pivoting through 45° to one side.

Figure 4:
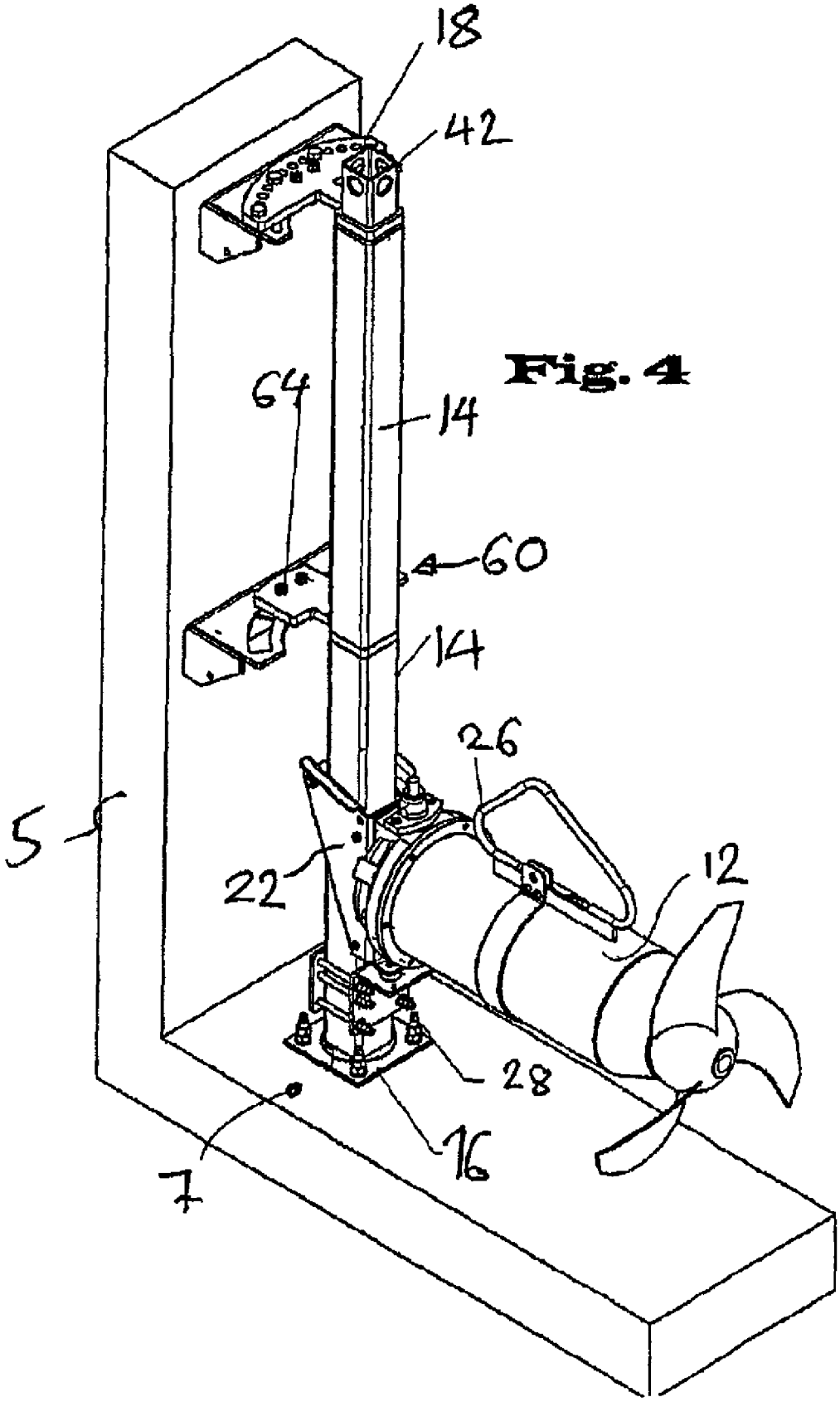
FIG. 4 is a perspective view of a second embodiment of a guiding device according to the invention.
Figure 7:
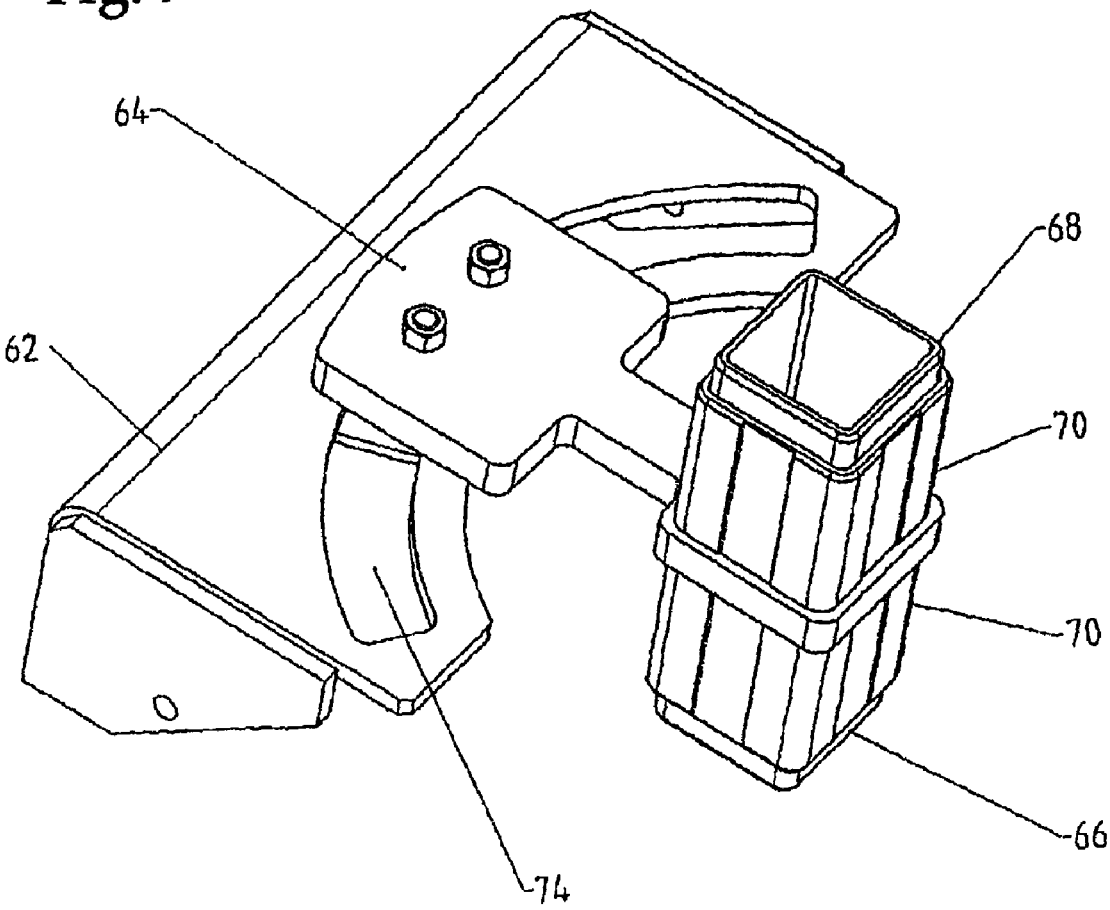
FIGS. 7 to 9 are perspective views of the center support of the guiding device according to the invention as shown in FIG. 4.
Figure 8:
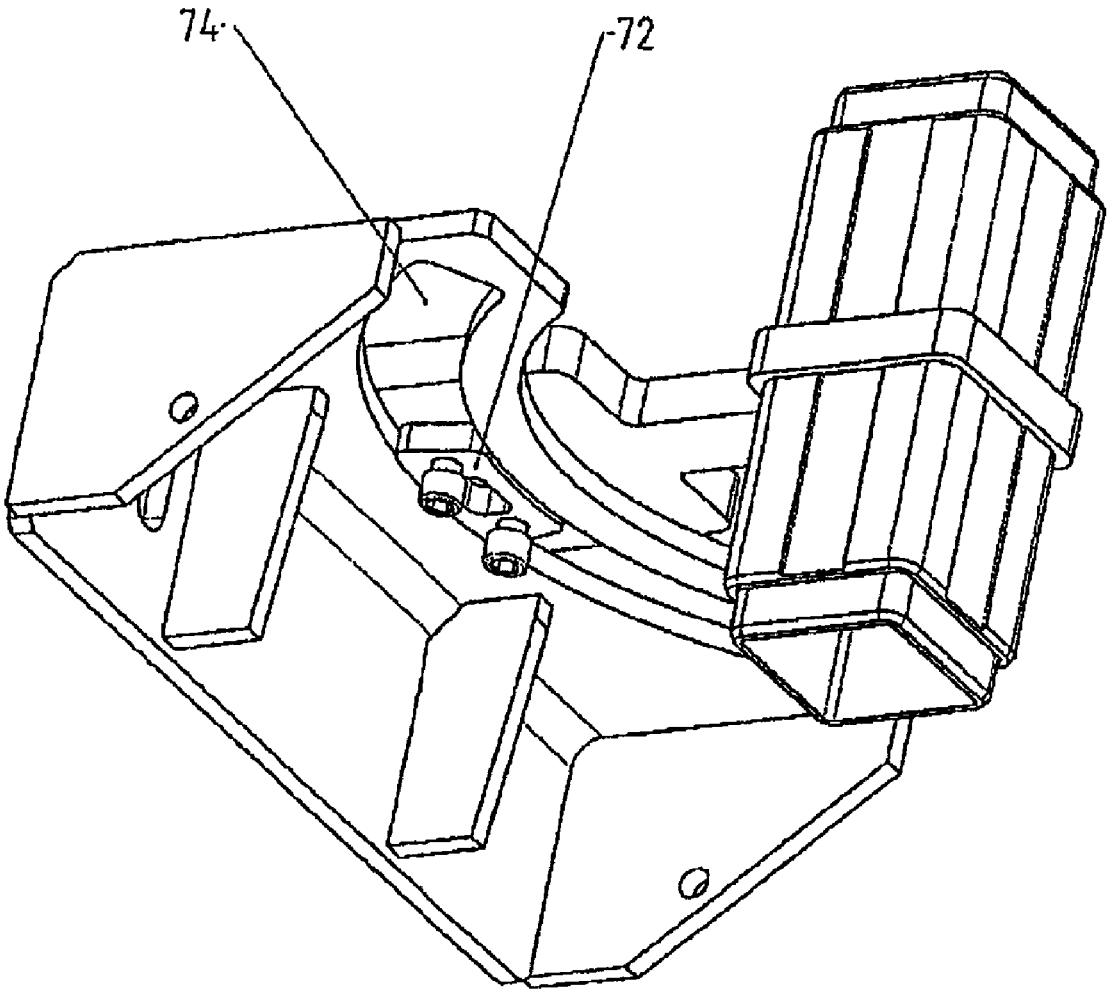
Figure 9:
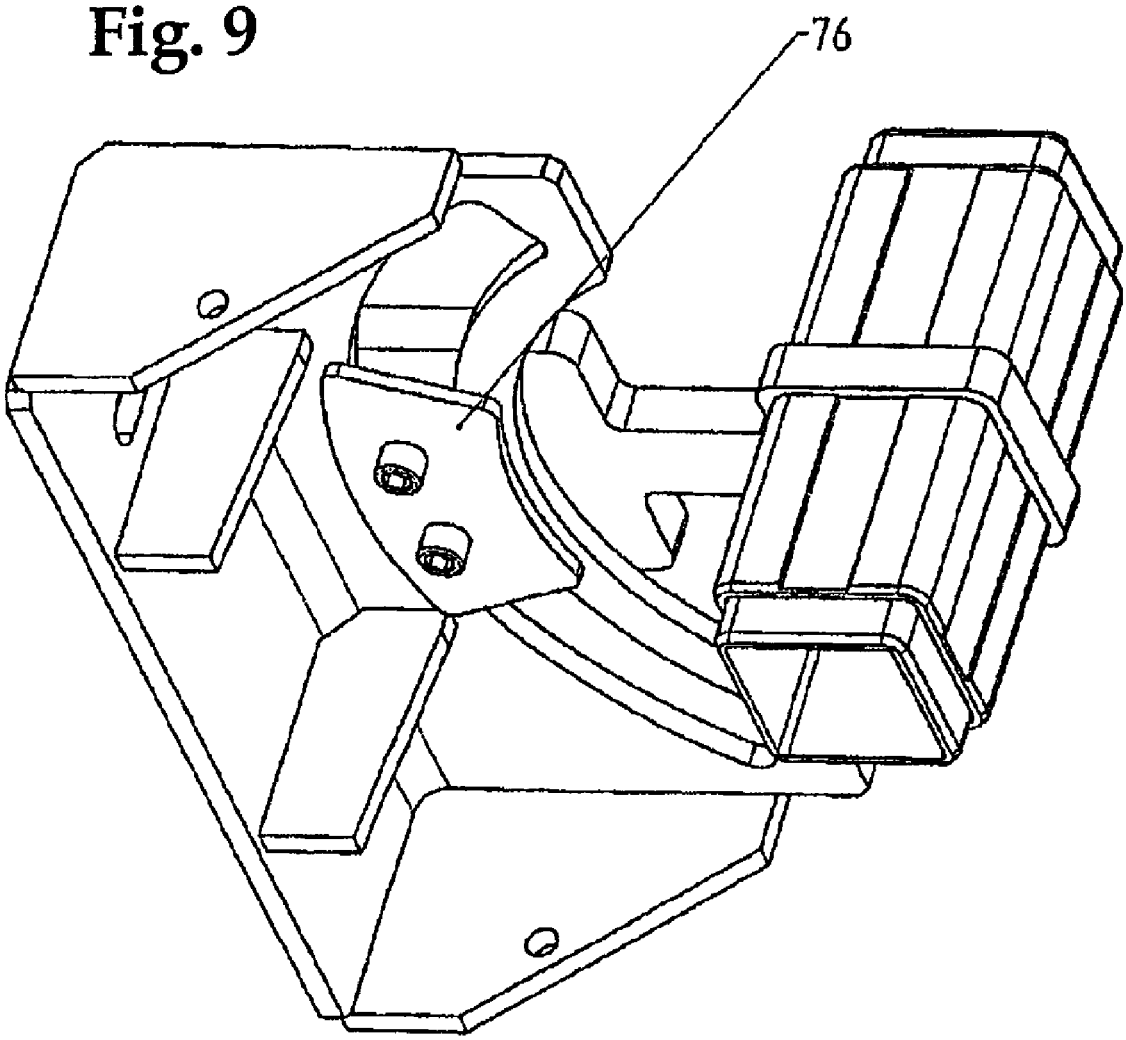

A further embodiment of the invention is shown in FIG. 4. The main parts of this figure correspond to those shown in FIG. 1. However, in this case, the guide tube is longer than 6 meters, as a result of which a center support 60 is provided, for stability reasons. As can be seen from FIGS. 7 to 9, the center support 60 likewise comprises a bracket 62 as well as a connecting lug 64. Moldings 66 and 68, in the form of quadrilateral tubes, are respectively welded to the top and bottom of the connecting lug. These also each have coatings 70 composed of an elastic material. The connecting lug 64 is guided in a curved longitudinal slot 74 by means of a sliding carriage 72. This is illustrated in detail in particular in FIG. 8, in which the lower holding plate 76, which is illustrated in FIG. 9, has been omitted.

In the area between the guide tube 12, which in the present case is formed from a plurality of pieces, and the bracket 62, the connecting lug 64 is likewise narrower than the intermediate space between the guide rollers 24 of the sliding carriage 22. The sliding carriage 22 can therefore easily likewise be removed without having to remove the center support 60 itself to do so in this case.

As can easily be seen in FIG. 3, the submersible motor agitator 12 can be pulled off the guiding device without any problems in any angular position.

The foregoing description and examples have been set forth merely to illustrate the invention and are not intended to be limiting. Since modifications of the described embodiments incorporating the spirit and substance of the invention may occur to persons skilled in the art, the invention should be construed broadly to include all variations within the scope of the appended claims and equivalents thereof.

The invention claimed is:

1. A guiding device for a submersible motor agitator comprising:

a guide tube mounted at a first end to a lower mount such that the guide tube can rotate about its axis and at a second end opposite said first end via an adjusting lug to an upper mount;

said upper mount comprising a mounting bracket installed in a fixed position to which the adjusting lug can be affixed in any of a number of predetermined angular positions; and a sliding carriage for holding the submersible motor agitator mounted on said guide tube;

wherein said sliding carriage surrounds the guide tube on three sides and has holders which partially enclose a fourth side of the guide tube not surrounded by the carriage such that an intermediate space is left, between the holders;

wherein the adjusting lug is narrower in the area between the guide tube and the mounting bracket than the intermediate space between the holders of the sliding carriage; and wherein an elongated curved slot is formed in the mounting bracket, and the adjusting lug is connected to a holding plate on the other side of the mounting bracket via at least one connector which extends between the adjusting lug and the holding date through said slot.

2. The guiding device according to claim 1, wherein the holders of the sliding carriage are formed by guide elements.

3. The guiding device according to claim 1, wherein the guide tube is in the form of a quadrilateral tube.

4. The guiding device according to claim 1, wherein one side of the adjusting lug is connected to a molding which has as cross-sectional shape match the guide tube and which can be inserted into the guide tube.

5. The guiding device according to claim 4, wherein said molding has an elastic coating.

6. The guiding device according to claim 1, wherein the adjusting lug is connected to an extension which has at least one opening for receiving an adjusting tool.

7. The guiding device according to claim 1, further comprising a center support which comprises a fixed-position connecting bracket and a connecting lug; said connecting lug having an area between the fixed-position connecting bracket and the guide tube which is narrower than the intermediate space between the holders of the sliding carriage.

8. The guiding device according to claim 7, wherein at least one of an upper face and a lower face of the connecting lug is connected to a molding which has a cross-sectional configuration matching the guide tube and which can be inserted into a respective section of the guide tube.

9. The guiding device according to claim 8, wherein said molding has an elastic coating.

10. The guiding device according to claim 1, wherein said at least one connector is a clamping screw.

11. The guiding device according to claim 1, wherein the connector is joined to a guide plate or guide roller which moves in said elongated slot.

12. A guiding device according for a submersible motor agitator comprising:

a guide tube mounted at a first end to a lower mount such that the guide tube can rotate about its axis and at a second end opposite said first end via an adjusting lug to an upper mount;

said upper mount comprising a mounting bracket installed in a fixed position to which the adjusting lug can be affixed in any of a number of predetermined angular positions;

a sliding carriage for holding the submersible motor agitator mounted on said guide tube; and a center support which comprises a fixed-position connecting bracket and a connecting lug; said connecting lug having an area between the fixed-position connecting bracket and the guide tube which is narrower than the intermediate space between the holders of the sliding carriage;

wherein said sliding carriage surrounds the guide tube on three sides and has holders which partially enclose a fourth side of the guide tube not surrounded by the carriage such that an intermediate space is left between the holders;

wherein the adjusting lug is narrower in the area between the guide tube and the mounting bracket than the intermediate space between the holders of the sliding carriage; and wherein elongated curved slots are formed in each of the mounting bracket and the connecting bracket, and the adjusting lug and the connecting lug are each connected to an associated holding plate on the other side of the mounting bracket or connecting bracket, respectively, via at least one connector which extends between the adjusting lug and its associated holding plate through the slot in the mounting bracket and via at least one connector which extends between the connecting lug and its associated holding plate through the slot in the connecting bracket.

13. The guiding device according to claim 12, wherein the connectors are clamping screws.

14. The guiding device according to claim 12, wherein the connectors are joined to guide plates or guide rollers which move in the respective elongated slots.

15. The guiding device according to claim 1, wherein the adjusting lug and the mounting bracket are connected to one another via a plurality of screws.

16. The guiding device according to claim 15, wherein a series of screw holes are provided in the adjusting lug or in the mounting bracket which allow the adjusting lug to be attached to the mounting bracket in any one of a number of angular positions.

* * * * *